US009375081B2

(12) United States Patent
Messing et al.

(10) Patent No.: US 9,375,081 B2
(45) Date of Patent: Jun. 28, 2016

(54) WALL-MOUNTED CABINET

(75) Inventors: Christoph Messing, Nidda (DE); Torben Basse, Sønderborg (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 13/514,826

(22) PCT Filed: Dec. 17, 2010

(86) PCT No.: PCT/DK2010/000179

§ 371 (c)(1),
(2), (4) Date: Jun. 18, 2012

(87) PCT Pub. No.: WO2011/072686

PCT Pub. Date: Jun. 23, 2011

(65) Prior Publication Data

US 2013/0088131 A1 Apr. 11, 2013

(30) Foreign Application Priority Data

Dec. 17, 2009 (DK) ..... 2009 1335

(51) Int. Cl.
*A47B 51/00* (2006.01)

(52) U.S. Cl.
CPC ..... *A47B 51/00* (2013.01)

(58) Field of Classification Search
CPC ..... A47B 67/02; A47B 51/00; A47B 46/00
USPC ..... 312/242, 245, 246, 247, 294, 306, 312, 312/319.5, 319.7, 319.8
See application file for complete search history.

(56) References Cited

U.S. PATENT DOCUMENTS

| | | | | |
|---|---|---|---|---|
| 2,889,442 | A * | 6/1959 | Schultz | 219/398 |
| 3,415,586 | A * | 12/1968 | Hammond | 312/312 |
| 5,927,144 | A | 7/1999 | Koch | |
| 6,471,311 | B1 * | 10/2002 | Snyder | 312/247 |
| 2004/0221775 | A1 | 11/2004 | Okninski | |
| 2006/0066188 | A1 * | 3/2006 | Crawford | 312/247 |

FOREIGN PATENT DOCUMENTS

| | | |
|---|---|---|
| DE | 3215572 | 10/1983 |
| DE | 3409990 | 7/1984 |
| DE | 29807238 | 8/1998 |
| DE | 202006009979 | 12/2007 |
| EP | 0402283 | * 12/1990 |

(Continued)

OTHER PUBLICATIONS

English Abstract of DE3215572.

(Continued)

*Primary Examiner* — James O Hansen
(74) *Attorney, Agent, or Firm* — Dykema Gossett PLLC

(57) ABSTRACT

Wall-mounted cabinet comprising a body (1) on each side of which is arranged a linear actuator (4). The linear actuator comprises a spindle (6) with a spindle nut, where the spindle is driven by a reversible electric motor via a transmission. The spindle nut is attached directly or indirectly to the side of the body (1), such that the body is lowered or raised in dependency of the direction of the revolution of the motor. The construction has the advantage that the internal of the body is completely clean for mechanical parts which lowers and raises the body. Moreover, the actuators only take up minimum space on the outer side of the body.

3 Claims, 1 Drawing Sheet

(56) References Cited

FOREIGN PATENT DOCUMENTS

| | | |
|---|---|---|
| GB | 1433004 | 4/1976 |
| GB | 2061700 | 5/1981 |
| GB | 2435612 | 9/2007 |
| JP | 49045823 | 4/1974 |
| WO | 2006024346 | 3/2006 |

OTHER PUBLICATIONS

English Abstract of DE3409990.

* cited by examiner

WALL-MOUNTED CABINET

BACKGROUND OF THE INVENTION

1. Field of the Invention

The present invention relates to a wall-mounted cabinet which includes a body and at least one linear actuator for lowering and raising the body.

2. The Prior Art

GB 2 061 700 to Don Joseph Anthony discloses a wall-mounted cabinet comprising a box open at the bottom with a shelf arrangement where the lower shelf constitutes a closure for the box. The shelf arrangement is in the sides guided by linear guides and can be raised and lowered by one linear actuator located inside the cabinet in the middle against the back plate. The actuator takes up a relatively large space in the cabinet and results at the same time in the cabinet not being particularly cleaning-friendly. When food or sanitary articles are stored in the cabinet, it is all together not particularly conductive to have an electro-mechanical arrangement inside the cabinet.

GB 1 433 004 to Michael John Hawker discloses a similar cabinet where the linear actuator is also mounted inside the cabinet. Different from the above, this cabinet has a front door in the nature of a sliding door which automatically opens upwards when the shelf arrangement is lowered. The opening of the sliding door is achieved due to a wire connected to the shelf arrangement. The structure thus requires a relatively large clearance above the cabinet.

DE 34 09 990 A1 to Hermann Dröge discloses brackets for top cabinets comprising a back plate intended for securing to a wall. The back plate is mounted with a spindle part and motor and further a guide at either side on which is mounted a plate for a top cabinet. When the motor is started, the top cabinet is raised and lowered. The construction takes up a relatively large space behind the cabinet, so that it must be positioned at a long distance from the wall.

A similar construction is known from DE 32 15 572 A1 to Hermann Dröge where a channel for the spindle is constructed in the back plate of the cabinet. For these constructions it is a fact that they are exposed to a large moment, which is transferred through the guides and the actuator. The moment is the weight of the cabinet multiplied by the lever arm, which approximately is half as long as the depth of the cabinet. Further, the construction may be exposed to a moment in the sideways direction if the cabinet is unequally loaded in the sides, which is quite common, e.g., a stack of heavy plates may be positioned in one side and perhaps a light bowl in the other side. Thus the cabinet will be exposed to a moment in the sideways direction, which can cause it to tip over.

DE 298 07 238 U1 Pro Reha discloses a bracket for top cabinets where the bracket comprises a steel plate at either end which are mutually connected with supporting profiles for the top cabinets. In either end of the bracket is a slanted linear actuator of the type disclosed in WO 96/12123 Dietmar Koch (OKIN). The top cabinets thus move in a slanted path out from the wall and downwards. The construction has the disadvantage that the actuators are mounted on a wall abutting the bracket.

The object of the invention is to avoid these drawbacks associated with such cabinets.

SUMMARY OF THE INVENTION

This is achieved according to the invention in that a linear actuator is mounted at either side of the body, the linear actuator including a spindle with a spindle nut, with the spindle driven by a reversible electric motor via a transmission, and wherein the spindle nut is attached directly or indirectly to the side of the body, such that the body is lowered or raised based on the direction of revolution of the motor, and including a control device and an operating device for controlling the actuators. By arranging a linear actuator on the exterior of the body of the cabinet at either side, the sanitary issue within the interior of the cabinet is in advance eliminated and the cabinet can without problems be used for storage of food and sanitary articles. Moreover, the body will also on the whole be designed and fitted as a normal cabinet in an element cabinet arrangement, such as an element kitchen, With an actuator at each side, the risk of tipping the body over is also minimized compared with a single centrally arranged actuator. Moment loading perpendicular to the cabinet on the linear actuators can also generally speaking be eliminated by placing these in a plane through the centre of gravity of the body, which typically is located midway inside the body. When there are two actuators, these can in principle be half the size, i.e., slimmer, as when there only is one actuator. This results in that each actuator does not take up so much space and further, when the spindle nut is attached directly on the exterior side of the body, the space the actuators take up can be further reduced.

In an embodiment a linear actuator of the type where the spindle projects perpendicularly from the housing containing the electric motor and the transmission is used. The actuator can be arranged such that the housing reaches across the top of the body while the spindle stretches down along the side of the body. Typically there would be sufficient space over the body for convenient arrangement of the housing of the actuator.

Regarding attachment of the actuator to the body, the spindle nut is in one embodiment designed for direct attachment to the side of the body. The spindle nut can be designed as a solid block or with projecting flanges with screw holes. Alternatively, there could be a steel bracket which is fixed to the spindle nut. In an embodiment the attachment between the spindle nut and the body could be a key assembly fitting, where the spindle nut is designed with one part of the key assembly fitting so that the spindle nut can be clasped onto the other part of the key assembly fitting mounted on the side of the cabinet.

In a further embodiment the spindle nut is connected to a tube-shaped rod which is attached to the side of the body. It is noticed that the tube-shaped rod protects and hides the spindle and at the same time prevents grease from the spindle from dripping from underneath the cabinet. It is understood that besides the wall thickness, the tube does not necessarily need to be much bigger than the diameter of the spindle.

The control unit typically comprises a primary control circuit located in a separate housing, known as a control box together with a power supply which usually is based on a transformer and a rectifier. The operation device may in its simplest form be a toggle switch, but typically it is a small panel with pressure or touch keys. Expediently, the control device is constructed to control the two linear actuators so that these run synchronously. Even though the linear actuators are identically manufactured, manufacturing tolerances and unequal load on these can cause the linear actuators not to run at the same speed, at which the body can run askew and in worst case be wedged. By constructing the control device so that the linear actuators are forced to run synchronously or parallel, this problem is avoided. Examples of such a control device are known from WO 02/03526 A2 and EP 1 079 51 1 A1, both Linak A/S.

BRIEF DESCRIPTION OF THE DRAWINGS

An embodiment of the inventions shall be more fully explained in the following with reference to the accompanying drawings, wherein.

DETAILED DESCRIPTION OF THE DEPICTED EMBODIMENT

Figure 1:
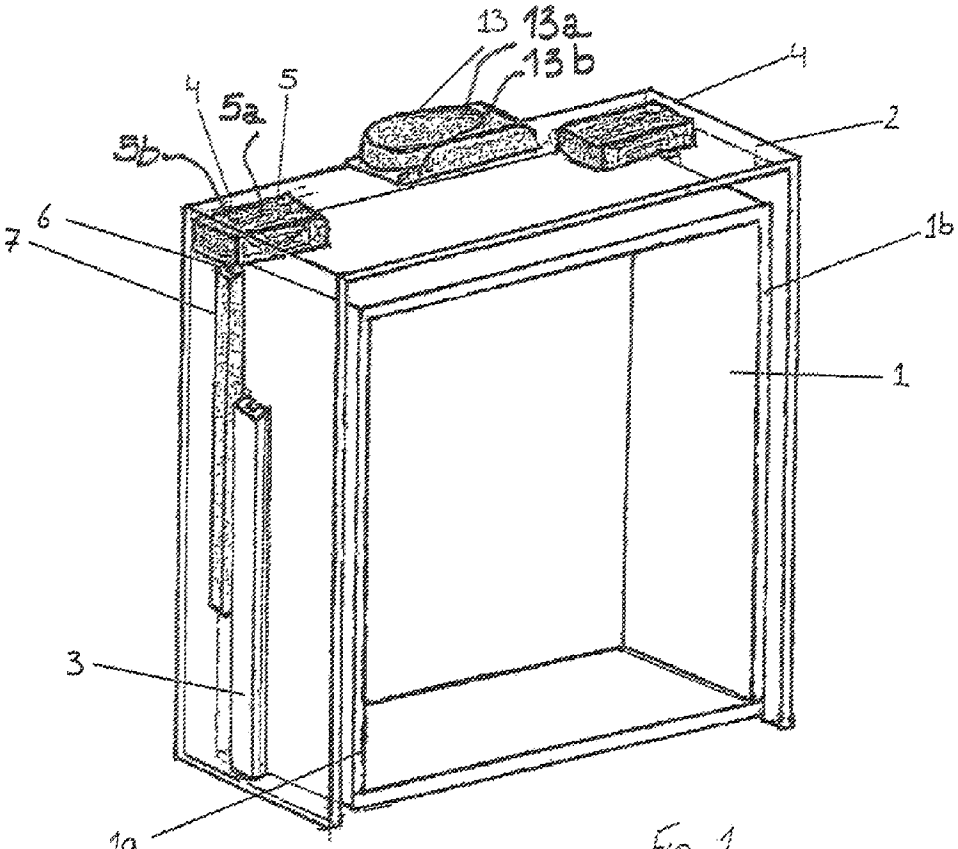
FIG. 1 is a perspective view of a cabinet according to the invention and where an outer shell is shown as transparent, and FIG. 2 a section of one side of the cabinet.

As it appears from FIG. 1, the cabinet comprises a body 1 in the shape of a box which is open at the front and has a first side wall l*a* and a second side wall l*b*. The body can be designed as a common element cabinet for an element cabinet arrangement and be equipped with a front door. Around the body 1 is an external cover shell 2, which is open at the bottom. Between the side walls l*a*, l*b* of the body 1 and the side walls of the cover shell 2 there are arranged linear guides 3, which could be common guide rails, e.g., drawer rails of the type disclosed in U.S. Pat. No. 6,478,393 B2 Samsung Electronics Co. Ltd.

For lowering and raising the body 1 a linear actuator 4 is located on either side of the body 1, each linear actuator comprising a housing 5 with a reversible low voltage DC-motor 5*a* and a transmission 5*b*. At the end of the housing 5 there is a spindle 6. On the spindle there is a spindle nut to which is connected a tube-shaped rod 7 with a square cross section.

Figure 2:
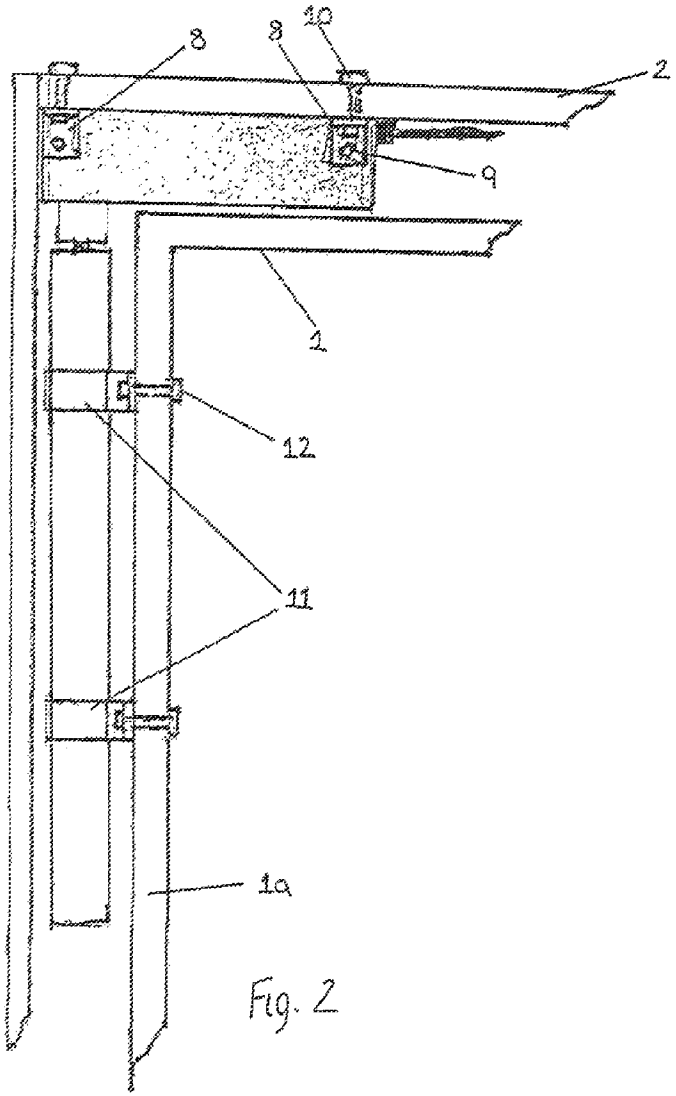

As it appears from FIG. 2, each linear actuator 4 is secured to the top of the cover shell 2 by means of angle braces 8, which are screwed onto the side of the housing 5 of the actuator with screws 9, and with screws 10 are screwed onto the top of the cover shell. The tube-shaped rod 7 of the actuator is secured to the side of the body 1 by clamping brackets 11. The clamping brackets 11 have sideways protruding flanges by means of which they are secured with screws 12 to the side of the body.

On top of the cover shell 2 there is located a control box 13 containing a power supply 13*a* and a control device 13*b* for the two actuators which are cable connected to the control box. It is noted that the control box alternatively could be mounted on the underside of the cover shell 2, so that it does not take up space on the cover shell. The cabinet will thus appear as having plane surfaces and immediately look like a conventional cabinet. The invention has the advantage that known standard linear actuators can be used, e.g., as disclosed in WO 2004/100632 A1 to Linak A/S. Another example of an actuator is disclosed in WO 02/39848 A1 to Linak A/S. For mounting at the top of the cover shell existing screw holes in the housing could be exploited. However more essential, these actuators are rather noiseless. Moreover, it is also essential that the squeeze protection known in connection with these actuators can be exploited directly, c.f., for instance the squeeze protection disclosed in WO 03/056976 A1 to Linak A/S , which is based on a piezo element.

The invention claimed is:

1. A wail-mounted cabinet assembly comprising:

a body having opposite side walls, a top wall, a bottom wall, and a back wall, an outer cover for said body, said outer cover including opposite side walls and a top wall, separate first and second linear actuator assemblies for moving said body downwardly out of and upwardly into said outer cover, each of said first and second linear actuator assemblies being positioned within the outer cover and adjacent a respective side wall of the outer cover and each of said first and second linear actuator assemblies including a housing located within the outer cover and connected to said top wall of said outer cover for containing a motor and a transmission, a spindle which extends downwardly from the housing between a respective side wall of the body and an adjacent side wall of the outer cover, a tube-shaped rod positioned around the spindle, and separate spaced connection means connecting the tube-shaped rod to an adjacent side wall of said body to move said body relative to said outer cover with rotation of said spindle, each said connection means comprising a clamping bracket that includes a sideways-extending protruding flange and a screw which extends through the flange and into the adjacent side wall of said body, and a control box connected to said first and second linear actuators to control operation of the motor in each of said first and second linear actuators.

2. The wall-mounted cabinet according to claim 1, wherein the housing of each of said first and second linear actuators is also positioned between the top wall of the body and the top wall of the outer cover, and where each spindle extends perpendicularly out of an associated housing.

3. The wall-mounted cabinet according to claim 1, including a linear guide rail positioned between each respective side wall of said body and the adjacent side wall of the outer cover.

* * * * *